US005441673A

United States Patent [19]

Gerhardy

[11] Patent Number: 5,441,673

[45] Date of Patent: Aug. 15, 1995

[54] CARBURETOR FOR AN INTERNAL COMBUSTION ENGINE

[75] Inventor: Reinhard Gerhardy, Korb, Germany

[73] Assignee: Andreas Stihl, Waiblingen, Germany

[21] Appl. No.: 325,939

[22] Filed: Oct. 19, 1994

Related U.S. Application Data

[63] Continuation-in-part of Ser. No. 11,516, Feb. 1, 1993, abandoned.

[30] Foreign Application Priority Data

Jan. 30, 1992 [DE] Germany ..... 42 02 538.9
Nov. 26, 1992 [DE] Germany ..... 42 39 673.5

[51] Int. Cl.[6] ..... F02M 17/04

[52] U.S. Cl. ..... 261/34.1; 261/DIG. 68; 261/35; 261/DIG. 38; 261/41.5

[58] Field of Search ..... 261/34.1, DIG. 68, DIG. 38, 261/41.5, 35

[56] References Cited

U.S. PATENT DOCUMENTS

| | | | |
|---|---|---|---|
| 2,711,883 | 6/1955 | Reeves | 261/DIG. 38 |
| 2,733,902 | 2/1956 | Phillips | 261/DIG. 68 |
| 2,951,690 | 9/1960 | Eberline | 261/DIG. 68 |
| 3,170,006 | 2/1965 | Brown | 261/DIG. 68 |
| 3,353,525 | 11/1967 | Nutten et al. | 261/DIG. 68 |
| 3,391,909 | 7/1968 | Sarto | 261/DIG. 38 |
| 3,409,277 | 11/1968 | Reise | 261/34.1 |
| 3,593,967 | 7/1971 | Nutten | 261/DIG. 68 |
| 3,758,084 | 9/1973 | Tuckey | 261/DIG. 68 |
| 3,791,632 | 2/1974 | Donovan | 261/DIG. 68 |
| 3,933,949 | 1/1976 | Woody | 261/DIG. 68 |

FOREIGN PATENT DOCUMENTS

| | | |
|---|---|---|
| 2164404 | 7/1973 | France . |
| 3929025 | 3/1991 | Germany . |

*Primary Examiner*—Tim R. Miles
*Attorney, Agent, or Firm*—Walter Ottesen

[57] ABSTRACT

The invention is directed to a carburetor for an internal combustion engine and includes an intake channel having a throttle flap mounted therein. Fuel passes from a fuel-filled control chamber via channels to main and idle nozzles through which the fuel enters the intake channel. The maximum permissible fuel quantity must be adjusted during a test run be means of an adjusting screw. This value can be changed by an operator. The maximum flow cross section for the fuel throughput is limited by at least one fixed throttle to which the main nozzle and the idle chamber are connected at the downstream end. In this way, strict exhaust-gas limit values are maintained. An adjustable throttle is provided with the aid of which the entire flow cross section can be reduced up to a pregiven minimum value. The carburetor described above is especially suitable for two-stroke engines of portable handheld work apparatus.

20 Claims, 4 Drawing Sheets

CARBURETOR FOR AN INTERNAL COMBUSTION ENGINE

RELATED APPLICATION

This application is a continuation-in-part application of application Ser. No. 08/011,516, filed on Feb. 1, 1993, now abandoned, and entitled "Carburetor for an Internal Combustion Engine".

BACKGROUND OF THE INVENTION

Published German patent application 3,929,025 (corresponding to U.S. patent application Ser. no. 07/822,146 filed on Jan. 17, 1992, now abandoned) discloses a carburetor for an internal combustion engine having a throttle flap mounted in the intake channel. At least one idle outlet bore opens into the region of the throttle flap and a main nozzle opens forward of the throttle flap viewed in the intake air flow direction. The main nozzle is connected via a fuel channel to a fuel-filled control chamber and the idle chamber is connected to the control chamber via a channel having a fixed throttle disposed therein. An opening having a variable cross section is disposed between the control chamber and the main nozzle. The cross section is changeable by means of a control screw accessible externally. The fuel quantity metered per unit of time to the intake channel is determined with the aid of this control screw.

U.S. Pat. 3,170,006 discloses a membrane carburetor having an independent idle system wherein a main nozzle is connected via two fuel-conducting paths to the fuel-filled control chamber. An opening is provided in a closure plate which determines a first fixed amount of fuel flowing to the main nozzle. Parallel thereto, a bore is provided in the housing of the carburetor which coacts with an adjustable needle and functions as an adjustable throttle. Needle valves of this kind cannot, however, be produced with any desired reduced maximum cross section so that a relatively large amount of fuel is supplied to the carburetor when the adjustable throttle is fully open.

In known arrangements, the maximum and/or minimum permissible fuel quantities are adjusted with the engine running and normal operating temperature. However, this is associated with a corresponding expenditure of effort. If the operator later adjusts the control screw during operation, then the previously adjusted maximum fuel quantity is no longer applicable and the carburetor must again be adjusted with a new measurement.

Furthermore, between the maximum open position and the closed position of the adjustable throttle, a cross sectional change is provided which is so large that the total passthrough quantity of fuel is doubled or increased therebeyond.

SUMMARY OF THE INVENTION

It is an object of the invention to provide a carburetor which can be set to a maximum fuel throughput at the factory without a special test run and can be later optimized within limits by the operator.

The invention is for a carburetor for an internal combustion engine. The carburetor includes: a carburetor housing defining an air-intake channel communicating with the engine and through which a stream of air flowing in an intake direction is drawn by suction when the engine is operating; a throttle flap pivotally mounted in said air-intake channel so as to be pivotable between an idle position wherein said throttle flap permits a minimal quantity of air to pass through said air-intake channel and a full-load position wherein said throttle flap permits a maximum quantity of air to pass through said air-intake channel; a main nozzle opening into said air-intake channel ahead of said throttle flap when viewed in said flow direction for metering fuel into said channel; said housing including a control chamber for holding fuel; main-nozzle fuel channel means connecting said main nozzle to said control chamber; an idle nozzle opening into said air-intake channel in the region of said throttle flap for metering fuel into said channel when said throttle flap is in said idle position; said housing further including an idle chamber; an idle-nozzle fuel channel connecting said idle nozzle to said idle chamber; fixed throttle means arranged in said main-nozzle fuel channel means between said main nozzle and said control chamber; said idle chamber being connected into said main-nozzle fuel channel means downstream of said fixed throttle means; said fixed throttle means being configured to define the maximum flow cross section for the fuel throughput supplied from said control chamber to said main nozzle and to said idle chamber; adjustable throttle means for adjusting said flow cross section from said maximum flow cross section down to a pregiven minimum flow cross section; and, said adjustable throttle means being adjustable between a first end position wherein said adjustable throttle means is fully closed and a second end position wherein said throttle means is fully open to effect a change of the total quantity of said fuel throughput between said first and second end positions with said change being a portion of said total quantity which corresponds to a maximum of 25% of said total quantity.

The essential advantages of the invention are seen in that the carburetor is set at the factory to a maximum fuel throughput or the so-called rich limit, and that an optimization of the fuel throughput can be adjusted in the direction of a minimum value (the so-called lean limit).

The adjustable range of the quantity of fuel is at most 25% of the total fuel throughput. In this way, the motorized apparatus satisfies even the most stringent exhaust gas requirements.

A fixed throttle flap having a diameter of 0.8 mm is seen as fully adequate for the maximum fuel throughput. However, the preferred dimension lies in the range between 0.65 mm to 0.7 mm. Insofar as the adjustable throttle is connected in parallel to the fixed throttle, the diameter of the fixed throttle can be slightly less than the diameter of such a fixed throttle which determines the entire passthrough quantity of the fuel. The fuel throughput for internal combustion engines utilized in portable handheld work apparatus lies in the range of approximately 1.8 kg/h to 2.0 kg/h.

An advantageous embodiment of the invention provides that the adjustable throttle is formed by a valve cone formed on the forward end of the main control screw and a valve seat in the fuel channel. This embodiment of an adjustable throttle is known per se in carburetors and has proved to be exceptional since even fractions of a screw rotation make possible a most sensitive change of the pass-through cross section and therefore a most sensitive metering of the fuel.

An especially advantageous embodiment is provided in that a first fuel channel having a fixed throttle arranged therein as well as a second fuel channel having an adjustable throttle are provided with the second fuel channel defining a bypass of the fixed throttle of the first fuel channel. In this way, a minimal fuel quantity (the lean limit) is fixed by the fixed throttle in the first fuel channel and the fuel mixture can be enriched in the direction of the rich limit by means of the throttle arranged in the bypass. The maximum degree of opening of the adjustable throttle can, for example, be obtained by limiting the displacement of the main control screw which, however, is not advantageous in every respect. It is therefore especially advantageous to provide a fixed throttle in the second fuel channel which, with respect to operation, is in series with the adjustable throttle.

This fixed throttle has a significantly smaller pass-through cross section than the fixed throttle for the main quantity of fuel so that the diameter of the throttle, which is arranged in series with the adjustable throttle, is in the range of 0.25 mm to 0.3 nm. In this way, the permissible maximum fuel quantity cannot be exceeded even when the adjustable throttle is opened beyond a specific pass-through cross section.

According to an alternate embodiment of the invention, it is also possible to provide a fuel channel with a fixed throttle limiting the total cross section and the adjustable throttle is arranged downstream of the fixed throttle. A flow channel is provided having a smaller cross section than the channel having the fixed throttle. This flow channel bypasses the adjustable throttle. In this embodiment, the total fuel quantity is conducted through the fixed throttle so that the fixed throttle is provided with a larger opening cross section than in the embodiment having two parallel throttles. The embodiment having only one fixed throttle is most significant for cost reasons because the manufacture of throttles having a very small cross section is difficult and cost-intensive. The flow channel bypassing the adjustable throttle is preferably defined by a central bore in the forward portion of the main control screw and a radial bore crossing this bore.

The flow channel has at least approximately the same cross section or diameter as the fixed throttle disposed forward thereof so that the control range of maximally 20% of the total passthrough quantity can be maintained.

A further embodiment provides two main nozzles in the region of the venturi section. The fixed throttle is arranged upstream of the first main nozzle and the adjustable throttle is mounted upstream of the second main nozzle. In this way, one of the two main nozzles is completely unaffected by the adjustable throttle. In such ax arrangement, it is advantageous that a fuel channel extends between the control chamber and the venturi section and this fuel channel ends at the first main nozzle and a fixed throttle is arranged in this fuel channel next to the control chamber and a fixed throttle of lesser cross section is arranged forward of the main nozzle and a parallel fuel channel branches off between the throttles. This parallel fuel channel leads to the second main nozzle and the adjustable throttle is mounted in this parallel fuel channel. As an alternate embodiment, a further fixed throttle and the adjustable throttle can be mounted in a second fuel channel. This second fuel channel opens into the second fuel nozzle and extends parallel to the first fuel channel. It is advantageous that the two main nozzles lie in one plane referred to the cross section of the venturi section so that both main nozzles are subjected to the same conditions with respect to the dynamic relationships in the venturi section.

The adjustable throttle is steplessly adjustable between a first position (completely closed) and a second position (completely open) because of the configuration of the adjustable throttle at the forward end of the main control screw. It has proven advantageous to configure the adjustable throttle so that the effective adjusting range of the adjustable throttle between the two positions corresponds approximately to a complete rotation of the main control screw.

It is further advantageous that the idle chamber is not connected directly to the control chamber as has been previously the practice so that the entire fuel quantity can be maintained as precisely as possible. Instead of being connected directly to the control chamber, the idle chamber is connected via a channel to the region of the fuel channel which lies between the fixed throttle and the main nozzle. In this way, a dependent supply of the idle chamber is provided so that there is no influence whatsoever on the maximum total fuel quantity. The channel connecting to the idle chamber has an end at the fuel channel. At this end, a fixed throttle and an adjustable throttle are provided with the adjustable throttle being downstream of the fixed throttle.

BRIEF DESCRIPTION OF THE DRAWINGS

The invention will now be described with reference to the drawings wherein.

BRIEF DESCRIPTION OF THE DRAWINGS

Figure 1:
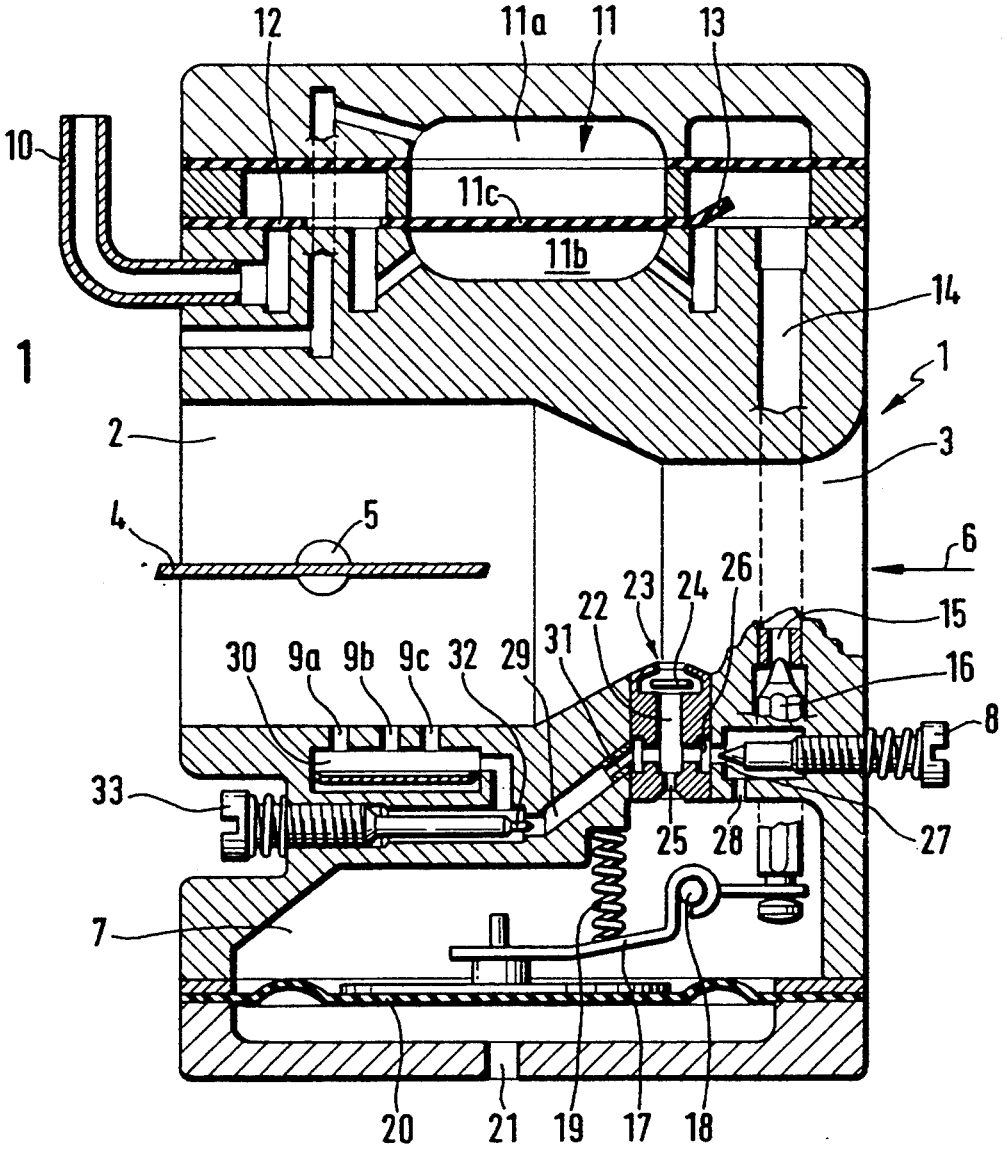
FIG. 1 is a section view of a first embodiment of a carburetor according to the invention.

In FIG. 1, a carburetor 1 is shown having an intake channel 2 with the intake channel having a venturi section 3. A throttle flap 4 is mounted in the intake channel 2 and is pivotally journalled to rotate on an axis 5. The carburetor communicates with the intake opening of a cylinder (not shown) of a two-stroke engine. The intake air is drawn through the venturi section 3 in the flow direction according to arrow 6. The carburetor is connected to a fuel tank-via the fuel line 10 and a membrane pump 11 is provided for pumping the fuel into the control chamber 7 of the carburetor. The work chamber 11*a* of the membrane pump 11 is connected via a line (not shown) to the crankcase of the two-stroke engine so that the membrane pump 11 is driven by the changing crankcase pressure. The membrane 11*c* is moved in the direction toward the work chamber 11*a* during underpressure so that an underpressure develops in the pump chamber 11*b* and fuel is drawn by suction from the fuel line 10 via the check valve 12. The membrane 11*c* is deflected in the direction toward the pump chamber 11*b* during overpressure in the crankcase. For this reason, the check valve 12 closes and the check valve 13 opens. Fuel is pumped via the open check valve 13 from the pump chamber 11*b* into a fuel line 14 to the control chamber 7.

The outlet end 15 of the fuel-feed line 14 lies in the control chamber 7 and is closed by a valve body 16. The valve body 16 is supported on a lever arm 17. The lever arm 17 is pivotally journalled on a pin 18 and a pressure spring 19 applies force to the lever arm 17 in the direction of a closure of the valve body 16. The spring 19 presses the free end of the lever 17 against a stop in the center of a control membrane 20 which, in turn, delimits the control chamber 7. The membrane 20 communicates via an opening 21 provided in the carburetor with the atmosphere or with a reference pressure level at the side of the membrane facing away from the control chamber 7.

The control chamber 7 is connected via a first fuel channel 22 to a main nozzle 23 which opens into the intake channel 2 in the region of the venturi section 3. The main nozzle coacts with an unloaded check platelet 24 which prevents pressure changes in the intake channel 2 from acting on the control chamber 7. A fixed throttle 25 is disposed in the fuel channel 22 and has a cross section which is so dimensioned that the fuel throughput is adequate for an operation of the engine with a fuel/air mixture which is as lean as possible.

Figure 3:
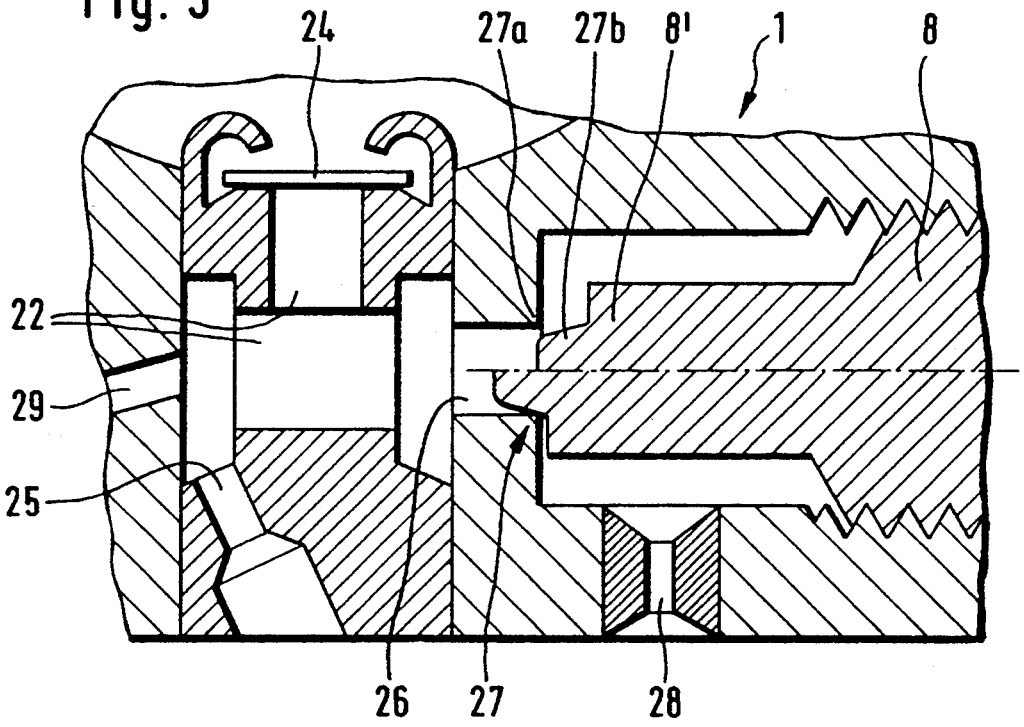
FIG. 3 is an enlarged detail view of the throttle configuration of the carburetor of FIG. 1.

In addition, a second fuel channel 26 is provided which extends from the control chamber 7. Starting at the control chamber 7, the second fuel channel 26 opens into the region of the first fuel channel 22 lying between the fixed throttle 25 and the check platelet 24. The enlarged detail view of FIG. 3 shows that an adjustable throttle 27 is mounted in the second fuel channel 26 with the throttle 27 being defined by a valve seat 27*a* and a valve cone 27*b*. The valve cone 27*b* is formed on the end 8' of a main control screw 8.

Although a valve cone 27*b* is shown in this embodiment, other geometric forms can also be considered which satisfy the same purpose. The cross section of the adjustable throttle 27 is changed by rotating the main control screw 8 with this adjustment extending to a complete closure of the second fuel channel 26. If the main control screw 8 is rotated in the opposite direction, then the valve cone 27*b* moves away from the valve seat 27*a*. A fixed throttle 28 is disposed upstream of the adjustable throttle 27 so that the fuel throughput cannot exceed a predetermined maximum value. The effective rotational angle of the main control screw 8 is thereby determined by the cross section of the fixed throttle 28. The effective rotational angle can, for example, be a maximum of a complete rotation (360° ) starting from the closure position of the valve 27. Any additional rotation of the main control screw 8 in the direction "open" then has no effect on the fuel supplied to the main nozzle 23.

A channel 29 starts from the first fuel channel 22 and leads to an idle chamber 30. A fixed throttle 31 as well as an adjustable throttle 32 are disposed in series in the channel 29. The idle chamber 30 is connected to the intake channel 2 via bores 9*a*, 9*b* and 9*c*. The adjustable throttle 32 is defined by a tip formed on the end of an adjusting screw 33 and a shoulder of the channel 29 whereby the fuel supply to the idle chamber 30 can be adjusted. Because of the connection of the channel 29 to the first fuel channel 22, the supply of fuel in the idle chamber 30 is also dependent upon the fuel quantity which reaches the first fuel channel 22 through the fixed throttle 25 and the adjustable throttle 27 and the fixed throttle 28 connected forward thereof.

The maximum fuel throughput and therefore also the rich limit FG of the fuel/air mixture in the intake channel 2 is determined by the arrangement, more specifically, the opening cross sections of the fixed throttles 25 and 28. This position of the opened adjustable throttle 27 is shown in FIG. 3 by the top half of the main control screw 8. The through cross section of the throttle 27 can be reduced continuously by rotating the main control screw 8 until the valve cone 27*b* is in contact engagement with the valve seat 27*a*. This position is shown by the lower half of the main control screw 8. Thus, the throttle 27 is closed in this position and the fuel reaches the first fuel channel 22 only through the fixed throttle 25. This corresponds to a lean limit MG of the fuel/air mixture.

Figure 2:
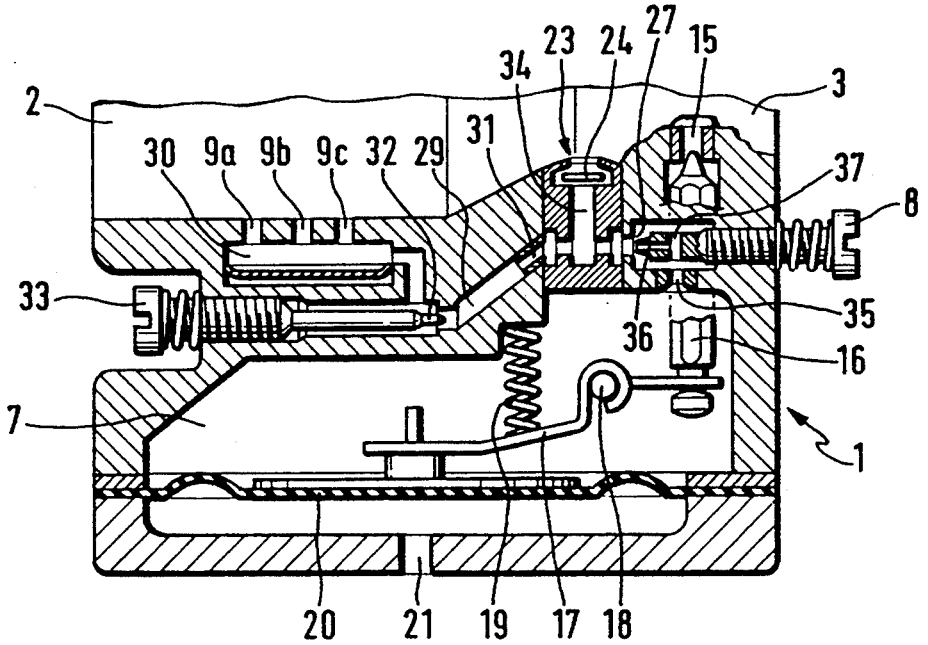
FIG. 2 is a second embodiment of the throttle arrangement.
Figure 4:
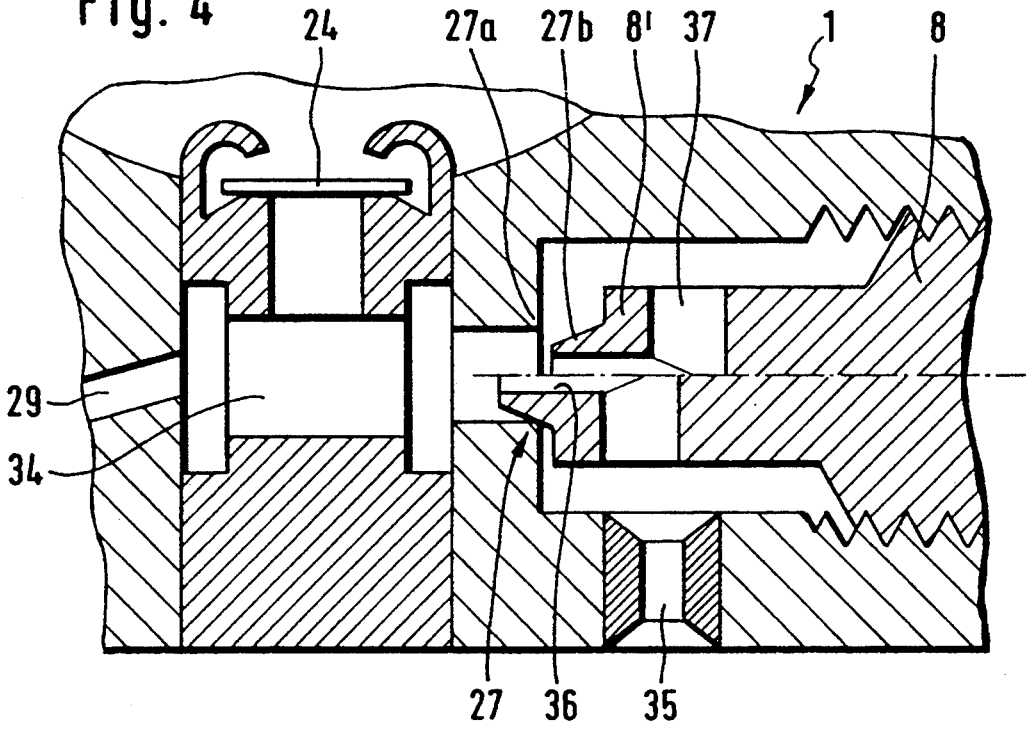
FIG. 4 is an enlarged detail view of the throttle configuration of FIG. 2.

In FIG. 2, the lower portion of the carburetor 1 is shown with the control chamber 7 as well as the outlet end 15 of the fuel-feed line and the valve body with the spring-biased lever arm 17. Those parts in FIG. 2 which perform the same function as the corresponding parts in FIG. 1 are identified by the same reference numerals. The main nozzle 23 is connected to the control chamber 7 via a fuel channel 34. A fixed throttle 35 is seated in the fuel channel 34 at the end thereof facing toward the control chamber. The adjustable throttle 27 is shown in series with the fixed throttle 35 when viewed in flow direction. The adjustable throttle 27 includes the valve seat 27*a* and the valve cone 27*b* as shown in FIG. 4. A central bore 36 and a radial bore 37 crossing the bore 36 are located within the valve cone 27*b*, that is, the forward end 8' of the main control screw 8. Accordingly, a flow channel having constant pass-through cross section is provided parallel to the adjustable throttle 27.

In this embodiment too, the effective rotational angle of the main control screw 8 is limited, for example, to a complete rotation starting from the closed position in the direction "open". If the main control screw 8 is rotated further, this rotation is without effect since the maximum cross section is determined by the fixed throttle 35. For a completely opened throttle 27, the engine receives the richest fuel mixture, that is, the permissible rich limit FG is reached.

In FIG. 4, this condition is shown by the upper half of the main control screw 8. The fuel mixture can however be adjusted leaner in that the throttle 27 is closed further so that less fuel flows therethrough. The flow channel defined by the bores 36 and 37 remains constant and guarantees an adequate fuel supply at the lean limit MG even when the throttle channel is closed.

Figure 5:
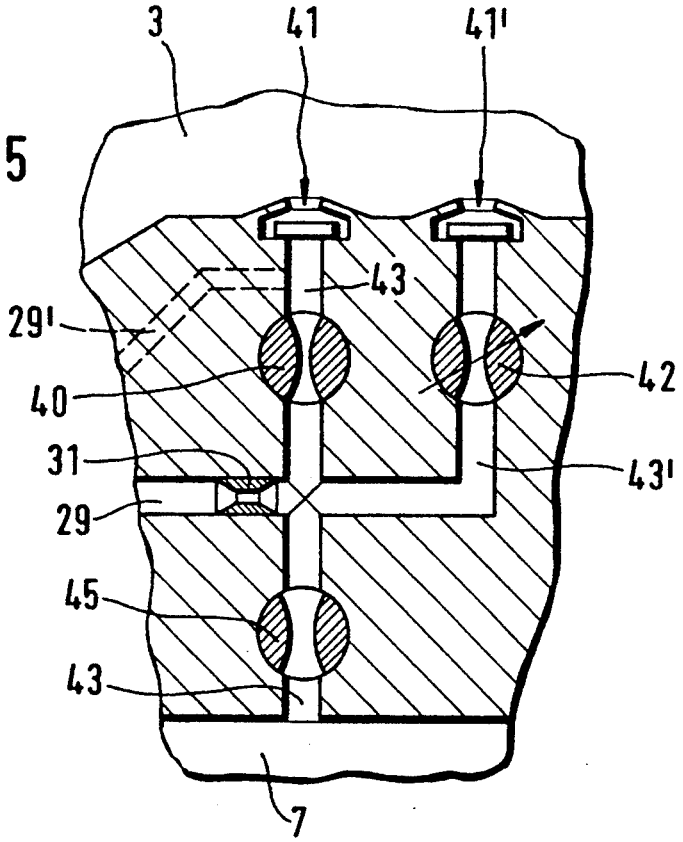
FIG. 5 is a schematic of the embodiment of FIG. 4 equipped with two main nozzles.

In the schematic of FIG. 5, two main nozzles 41 and 41' are arranged in the region of the venturi section 3. The main nozzles 41 and 41' communicate via respective fuel channels 43 and 43' with the control chamber 7. Starting from the control chamber 7, a fixed throttle 45 is disposed in fuel channel 43 and determines the maximum fuel throughput. The parallel fuel channel 43' branches off downstream of this throttle 45 as does the channel 29 containing the fixed throttle 31 with the channel 29 leading to the idle chamber. An additional fixed throttle 40 is disposed in a further section of the fuel channel 43 and determines the minimum fuel throughput and, accordingly, has a lesser cross section than the throttle 45. The first main nozzle 41 is arranged at the end of the fuel channel 43. An adjustable throttle 42 is disposed in the parallel fuel channel. An additional fuel quantity is supplied by means of the throttle 42, in dependence upon the degree of opening of the throttle 42, to the venturi section 3 via the second main nozzle 41'.

As an alternate to the embodiment of the channel 29 leading to idle chamber, a channel 29' can be connected into the section between the fixed throttle 40 and the first main nozzle 41 as shown in phantom outline in FIG. 5. The throughflow direction of the venturi section 3 corresponds to that which is given in FIG. 1 by the arrow 6; that is, the main nozzles 41 and 41' lie one behind the other in the flow direction of the intake air.

Figure 6:
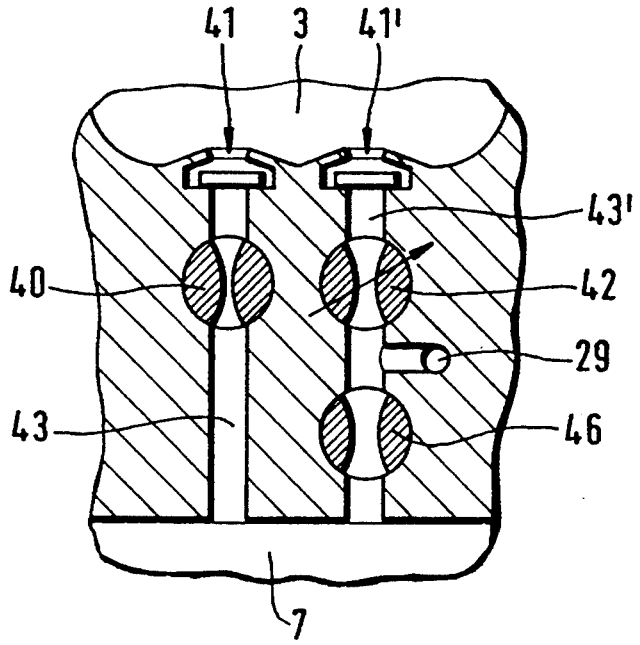
FIG. 6 is a variation of the embodiment shown in FIG. 5.

A schematic of the arrangement of two main nozzles 41 and 41' is shown in FIG. 6. The main nozzles (41, 41') lie in one plane referred to the cross-sectional form of the venturi section 3. In this embodiment, the fuel channel 43 does not have a branch extending therefrom. The fuel channel 43 has the fixed throttle 40 disposed therein which determines the minimum fuel quantity and therefore the lean limit of the mixture. The parallel fuel channel 43' extends from the control chamber 7 to the second main nozzle 41'. A fixed throttle 46 and the adjustable throttle 42 are connected in series in this fuel channel 43'. The mixture between the lean limit and tile rich limit can be adjusted in dependence upon the degree of opening of the adjustable throttle 42. The channel 29 leads to the idle chamber and tile connection thereof is disposed in the region of the fuel channel 43' between the throttles 46 and 42.

Figure 7:
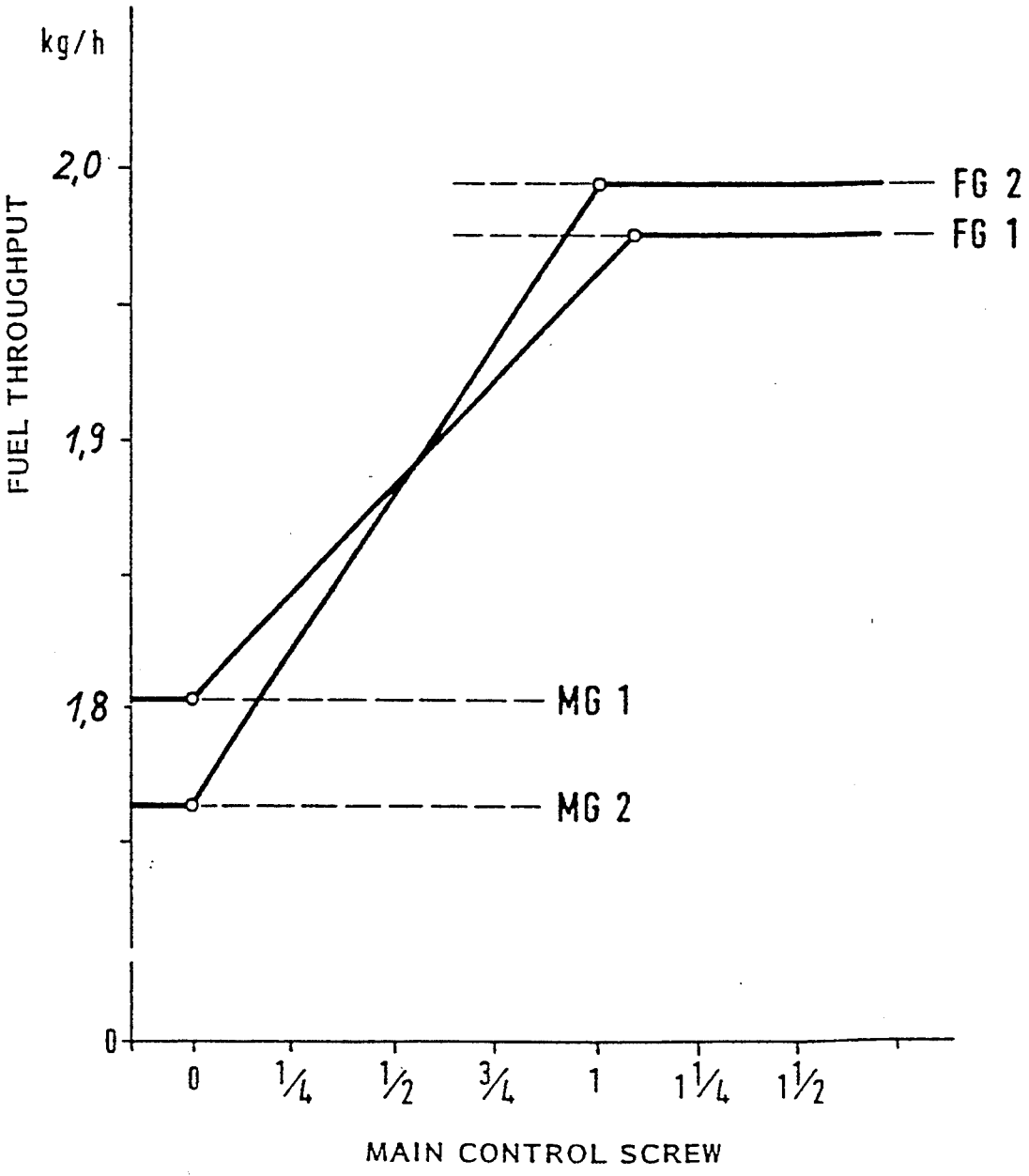
FIG. 7 shows characteristics of the fuel consumption in dependence upon the setting of the main control screw.

In FIG. 7, the fuel throughput is shown in kg/h in dependence upon the adjustable throttle, that is, upon the rotational position of the main control screw. The main control screw is in the position "0" starting from the state of the closed adjustable throttle. This means the least fuel throughput which is shown with MG1 and MG2 for the different embodiments. FIG. 7 shows that the maximum effective throttle opening is reached with approximately one rotation of the main control screw and is identified by the corresponding rich limits FG1 and FG2. The characteristic lines run approximately proportional between one lean limit MG1 or MG2 and the corresponding rich limit FG1 or FG2.

As shown in FIG. 7, the fuel quantity can be reduced from the rich limit FG by about 10% to 12% to the lean limit MG.

It is understood that the foregoing description is that of the preferred embodiments of the invention and that various changes and modifications may be made thereto without departing from the spirit and scope of the invention as defined in the appended claims.

What is claimed is:

1. A carburetor for an internal combustion engine, the carburetor comprising:

a carburetor housing defining an air-intake channel communicating with the engine and through which a stream of air flowing in an intake direction is drawn by suction when the engine is operating;

a throttle flap pivotally mounted in said air-intake channel so as to be pivotable between an idle position wherein said throttle flap permits a minimal quantity of air to pass through said air-intake channel and a full-load position wherein said throttle flap permits a maximum quantity of air to pass through said air-intake channel;

a main nozzle opening into said air-intake channel ahead of said throttle flap when viewed in said flow direction for metering fuel into said channel;

said housing including a control chamber for holding fuel;

main-nozzle fuel channel means connecting said main nozzle to said control chamber;

an idle nozzle opening into said air-intake channel in the region of said throttle flap for metering fuel into said channel when said throttle flap is in said idle position;

said housing further including an idle chamber;

an idle-nozzle fuel channel connecting said idle nozzle to said idle chamber;

fixed throttle means arranged in said main-nozzle fuel channel means between said main nozzle and said control chamber;

said idle chamber being connected into said main-nozzle fuel channel means downstream of said fixed throttle means;

said fixed throttle means being configured to define the maximum flow cross section for the fuel throughput supplied from said control chamber to said main nozzle and to said idle chamber;

adjustable throttle means for adjusting said flow cross section from said maximum flow cross section down to a pregiven minimum flow cross section; and, said adjustable throttle means being adjustable between a first end position wherein said adjustable throttle means is fully closed and a second end position wherein said throttle means is fully open to effect a change of the total quantity of said fuel throughput between said first and second end positions with said change being a portion of said total quantity which corresponds to a maximum of 25% of said total quantity.

2. The carburetor of claim 1, said air-intake channel defining a venturi section extending longitudinally along a portion of said air-intake channel; said main nozzle being a first main nozzle and said carburetor including a second main nozzle; said first and second main nozzles opening into said air-intake channel in the region of said venturi section; said main-nozzle fuel channel means including: a first channel extending between said first main nozzle and said control chamber; and, a second channel extending between said second main nozzle and said control chamber; said fixed throttle means being arranged in said first channel; and, said carburetor further including ancillary fixed throttle means arranged in said second channel and said adjustable throttle means also being arranged in said second channel so as to be in series with said ancillary fixed throttle means.

3. The carburetor of claim 1, said carburetor being a membrane carburetor.

4. The carburetor of claim 1, wherein said portion of said total quantity to be changed corresponds to approximately 10% to 12% of said total quantity of said fuel throughput.

5. The carburetor of claim 4, said fixed throttle having a maximum diameter of 0.75 mm.

6. The carburetor of claim 4, said fixed throttle having a diameter in the range of 0.65 mm to 0.7 mm.

7. The carburetor of claim 1, said main-nozzle fuel channel means including a first channel extending between said main nozzle and said control chamber; said fixed throttle means being a first fixed throttle disposed in said first channel; said idle-nozzle fuel channel including a channel segment extending from said idle chamber and being connected to said first channel downstream of said fixed throttle means; said main-nozzle fuel channel means including a second channel connected into said first channel downstream of said fixed throttle means and extending to said control chamber thereby defining a bypass channel with respect to said fixed throttle means; said adjustable throttle means being arranged in said bypass channel; and, said carburetor further including a second fixed throttle mounted in said second channel so as to be in series with said adjustable throttle means.

8. The carburetor of claim 5, said second fixed throttle having a maximum diameter of 0.3 mm.

9. The carburetor of claim 1, said air-intake channel defining a venturi section extending longitudinally along a portion of said air-intake channel; said main nozzle being a first main nozzle and said carburetor including a second main nozzle; said first and second main nozzles opening into said air-intake channel in the region of said venturi section; said main-nozzle fuel channel means including: first and second channel segments extending from said first and second main nozzles, respectively; and, a third channel segment having a first end connected to both of said first and second channel segments and having a second end connected to said control chamber; said fixed throttle means being arranged in said third channel segment; and, said carburetor further including ancillary fixed throttle means arranged in said first channel segment and said adjustable throttle means being arranged in said second channel segment.

10. The carburetor of claim 9, said ancillary fixed throttle means having a flow cross section less than said maximum flow cross section of said fixed throttle means arranged in said third channel segment.

11. The carburetor of claim 9, said first and second main nozzles being disposed in a common plane.

12. The carburetor of claim 9, said first and second main nozzles being disposed in a common plane.

13. The carburetor of claim 1, said main-nozzle fuel channel means having a main channel segment for accommodating said fixed throttle means and said adjustable throttle means therein; said idle-nozzle fuel channel having an idle-nozzle channel segment connecting said idle chamber to said main channel segment downstream of said fixed throttle means and said adjustable throttle means when viewed in a flow direction of the fuel flowing from said control chamber to said idle chamber and said main nozzle; and, said carburetor further including bypass channel means for bypassing said adjustable throttle means.

14. The carburetor of claim 13, said bypass channel means having a cross section less than said fixed throttle means.

15. The carburetor of claim 13, said bypass channel means having a cross section equal to the cross section of said fixed throttle means.

16. The carburetor of claim 13, further comprising: additional fixed throttle means arranged in said idle-nozzle channel segment; and, additional adjustable throttle means arranged in said idle-nozzle channel segment so as to be in series with said additional fixed throttle means.

17. The carburetor of claim 13, said adjustable throttle means including: a valve seat formed in said main channel segment; a main control screw having a conical valve body formed thereon; and, said main control screw being movably mounted in said housing so as to move said conical valve body toward and away from said valve seat thereby varying said flow cross section between said maximum and minimum flow cross sections.

18. The carburetor of claim 17, said conical valve body defining a longitudinal axis; and, said bypass channel means including a central bore formed in said conical valve body along said axis and a radial bore crossing said central bore.

19. The carburetor of claim 17, said main control screw being threadably mounted in said housing so as to be steplessly rotatable between said first end position wherein said adjustable throttle means is fully closed and said second end position wherein said adjustable throttle means is fully opened.

20. The carburetor of claim 19, said main control screw being rotatable between said end positions by approximately one revolution.

* * * * *

UNITED STATES PATENT AND TRADEMARK OFFICE

CERTIFICATE OF CORRECTION

PATENT NO. : 5,441,673

DATED : August 15, 1995

INVENTOR(S) : Reinhard Gerhardy

It is certified that error appears in the above-indentified patent and that said Letters Patent is hereby corrected as shown below:

In the title page, in the abstract, line 7: delete "be means of" and substitute -- by -- therefor.

In column 3, line 20: delete "0.3 nm" and substitute -- 0.3 mm -- therefor.

In column 3, line 53: delete "ax" and substitute -- an -- therefor.

In column 4, line 56: delete "tank-via" and substitute -- tank via -- therefor.

In column 6, line 46: delete "can however" and substitute -- can, however, -- therefor.

In column 7, line 5: between "to" and "idle", insert -- the --.

In column 7, line 23: delete "tile" and substitute -- the -- therefor.

UNITED STATES PATENT AND TRADEMARK OFFICE

CERTIFICATE OF CORRECTION

PATENT NO. : 5,441,673

DATED : August 15, 1995

INVENTOR(S) : Reinhard Gerhardy

It is certified that error appears in the above-indentified patent and that said Letters Patent is hereby corrected as shown below:

In column 7, line 26: delete "tile" and substitute -- the -- therefor.

Signed and Sealed this

Twenty-first Day of November, 1995

Bruce Lehman

*Attest:*

BRUCE LEHMAN

*Attesting Officer*

*Commissioner of Patents and Trademarks*